US005730501A

United States Patent [19]

Grathoff et al.

[11] Patent Number: 5,730,501

[45] Date of Patent: Mar. 24, 1998

[54] CONTINUOUS TRACK MOUNTED, SELF PROPELLED OPEN CAST MINING APPARATUS

[75] Inventors: Hartmut Grathoff, Wendelstein; Mario Dielefeld, Fürth, both of Germany

[73] Assignee: Man Takraf Fördertechnik GmbH, Leipzig, Germany

[21] Appl. No.: 597,430

[22] Filed: Feb. 8, 1996

[30] Foreign Application Priority Data

Feb. 15, 1995 [DE] Germany ..... 195 05 042.8

[51] Int. Cl.[6] ..... E21C 35/20; E21C 47/04

[52] U.S. Cl. ..... 299/39.2; 37/95; 37/351; 299/68

[58] Field of Search ..... 299/39.2, 67, 68; 37/95, 97, 350, 351

[56] References Cited

U.S. PATENT DOCUMENTS

| | | | |
|---|---|---|---|
| 1,968,107 | 7/1934 | Vodoz | 299/68 |
| 4,718,537 | 1/1988 | Miller | 37/351 X |
| 5,092,659 | 3/1992 | Grathoff | 299/39.2 |
| 5,152,583 | 10/1992 | Grathoff et al. | 299/39.2 |

FOREIGN PATENT DOCUMENTS

| | | | |
|---|---|---|---|
| 40 17 107 A1 | 3/1991 | Germany . | |
| 39 20 011 | 9/1991 | Germany . | |
| 40 15 126 C1 | 10/1991 | Germany . | |
| 827704 | 5/1981 | U.S.S.R. | 37/351 |

*Primary Examiner*—David J. Bagnell
*Attorney, Agent, or Firm*—McGlew and Tuttle

[57] ABSTRACT

The open cast mining apparatus comprises two sets of running gear between which a cutting drum is provided on a chassis. The conveyor tract is formed by an axial discharge conveyor inside the cutting drum, a vertical worm conveyor and a conveyor in the discharge jib or in the connecting bridge. The latter is supported on a loading carriage travelling parallel to a working face belt. The cutting drum is so designed that the mining machine can excavate and pick up material to be conveyed in both travelling directions.

21 Claims, 13 Drawing Sheets

36
60
4
16a
22

36
16a
60
16a 36
16a
60
16a

CONTINUOUS TRACK MOUNTED, SELF PROPELLED OPEN CAST MINING APPARATUS

FIELD OF THE INVENTION

The invention relates to an open cast mining apparatus including a cutting drum fired underneath a chassis and including running gear sets adapted to be raised, lowered and steered fitted respectively ahead of and behind the chassis, viewed in the travel direction, and including, accommodated in the cutting drum, an axially arranged bulk material conveyor.

BACKGROUND OF THE INVENTION

Continuously operating mining apparatus for open cast mining, including a drum-shaped mining means are known from U.S. Pat. No. 5,092,659 (see also DE 39 20 011 and DE 40 17 107). These relate to self-propelled apparatus travelling on a crawler gear including a drum-shaped horizontally orientated mining device and a discharge conveyor associated therewith.

The cutting drum, armed with cutting picks, can perform a mining operation in both directions of rotation.

The material being conveyed is transported into the interior of the cutting drum.

Cutter beams are fitted essentially axially on the drum circumference and the pick holders fitted to the cutter beams carry picks. The pick holders, including the picks, are tillable about an axis of rotation in such a manner that the picks directed in the direction of rotation, when engaging the material to be mined, automatically swivel into the cutting position and the oppositely directed picks are simultaneously swung out of the range of the clean cutting angle of the picks which perform the excavating work.

The material mined is conveyed by the cutter beams and the conveyor baffles by way of an annular chute and a feed chute onto a discharge belt accommodated axially inside the cutting drum and which transfers the mined material at the end face of the drum onto further conveyor means provided outside of the cutting drum.

According to DE 40 17 107, each individual crawler is provided with a power sensor and a stroke sensor. On the chassis of the apparatus a position sensor is furthermore provided which measures the longitudinal and transverse inclination. An automatising apparatus in which preset data is stored and into which the signals of the individual sensors are entered controls the distribution of loads onto the individual crawlers during different operating phases of the mining apparatus and the compliance with the spatial position of the apparatus chassis in a predetermined longitudinal and transverse inclination. The travel gear of the mixing apparatus may also comprise three or more crawlers or wheel sets both in front as well as behind. A wheel set may be composed of one, two or four wheels.

A continuously operating mining apparatus for open cast mining including a drum-shaped mining device is furthermore known from DE 40 15 126. This mining apparatus includes a drum-shaped mining device on the circumferential surface of which cutting bits are fitted, the circumferential surface comprising recesses for the discharge of the material being conveyed by way of a feed chute onto a discharge conveyor accommodated axially inside the drum. The discharge conveyor is in the form of an endless conveyor. The first section of the discharge conveyor extends axially inside the cutting drum. Outside of the cutting drum the discharge conveyor continues in the form of a vertical conveyor extending up to the level of the upper edge of the chassis of the mining apparatus. The last section of the discharge conveyor extends above the chassis at a slight incline and terminates in the transfer region.

The discharge conveyor is covered by a smooth and plane cover belt which begins at the end of the discharge conveyor which is accommodated inside the drum and which terminates in the transfer region.

The known C-shaped endless conveyor has a number of advantages which become particularly noticeable with relatively large machines, e.g. in those having conveyor capacities of 5000 $m^3/h$ and more. With smaller machines, in particular those having conveyance capacities below 1000 m/h it is hardly possible to make the end face aperture of the horizontal cutting drum sufficiently large for the above-described C-shaped endless conveyor to pass therethrough.

GENERAL DESCRIPTION OF THE INVENTION

A need exists for an open cast mining apparatus operating equally in both directions of travel including a drum-shaped mining device operating by a cutting action which, even in smaller construction sizes is capable of transferring the bulk material continuously through a belt bridge linked on above the machine chassis onto a loading carriage travelling parallel to a working face belt or onto other conveyor means by way of a discharge jib linked on above the machine chassis.

The present invention provides an open cast mining apparatus including a cutting drum fitted underneath a chassis and including travel gear sets adapted to be raised, lowered and steered fitted respectively ahead of and behind the chassis, viewed as the travel direction, and cutting drum drive means provided at both end faces and including a chute axially accommodated in the cutting drum and an axially arranged bulk material conveyor, wherein at one end face aperture of the horizontally positioned cutting drum a vertical worm conveyor is provided, extending to a level above the apparatus chassis, wherein at the lower end of the vertical worm conveyor a vertical cutting drum is provided which revolves coaxially in relation to the worm shaft, wherein the axial bulk material conveyor accommodated in the horizontal cutting drum discharges the bulk material into a bulk material receiving aperture at the lower end of the vertical worm conveyor, and wherein at the upper end of the worm conveyor a bulk material transfer chute is provided which transfers the bulk material onto an onwardly conveying conveyor means (bulk material conveyor).

The most important advantage of the invention as against the state of the art as known in particularly from the inventions according to DE 39 20 011, DE 39 24 675 and DE 40 15 126 was found to be that it is possible, due to the particular design of the picking up device, to also build smaller machines. It is also possible to provide open cast mining machines including a very robust conveyor tract constructed of few individual components.

Furthermore, it is possible by means of the invention, to lay out, in open cast mining, side slopes of optional steepness without auxiliary apparatus.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF SPECIFIC EMBODIMENTS

Figure 1:
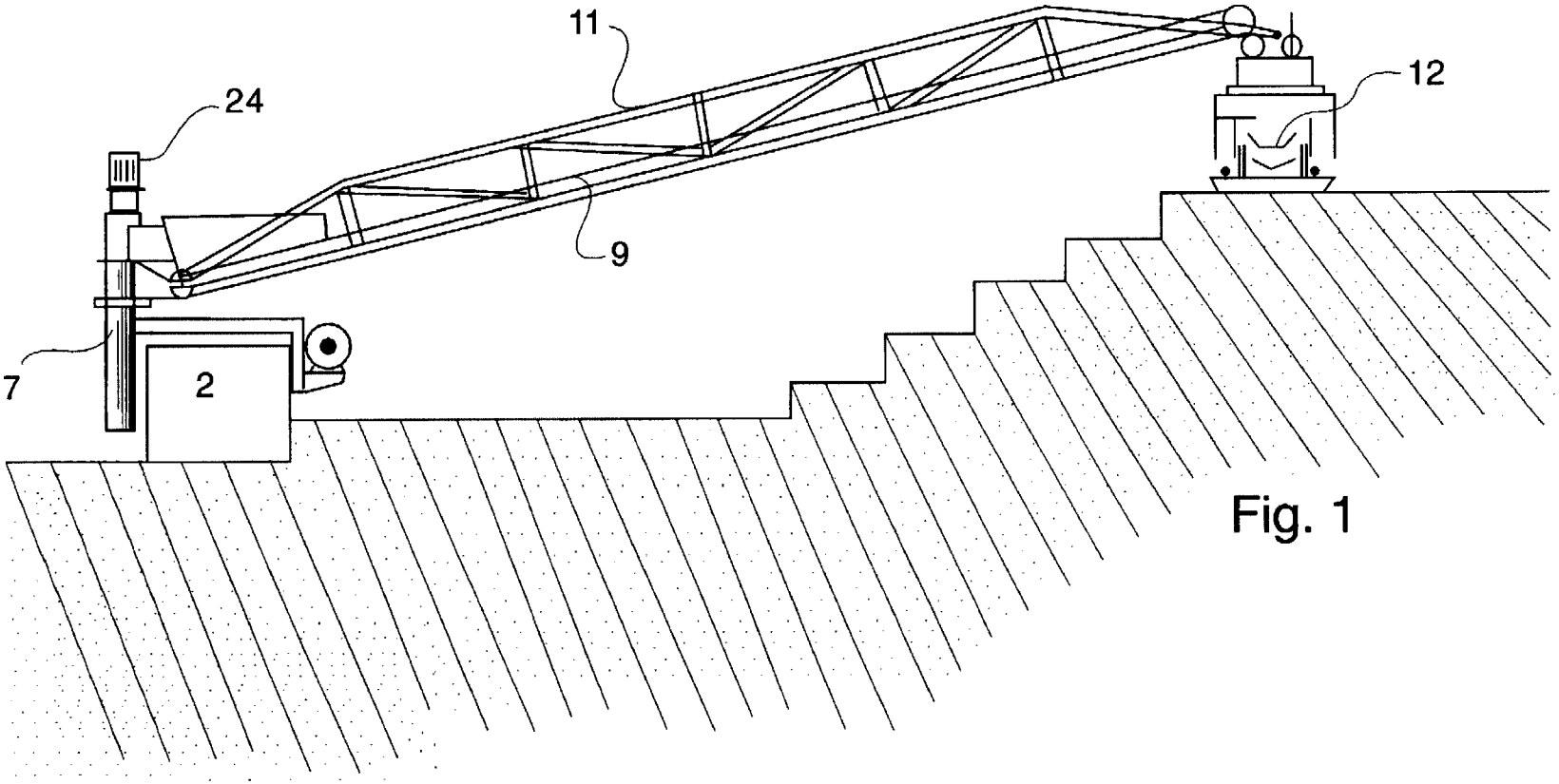
FIG. 1 a general view of the open cast mining apparatus including connection bridge, loading carriage and working face belt.
Figure 2:
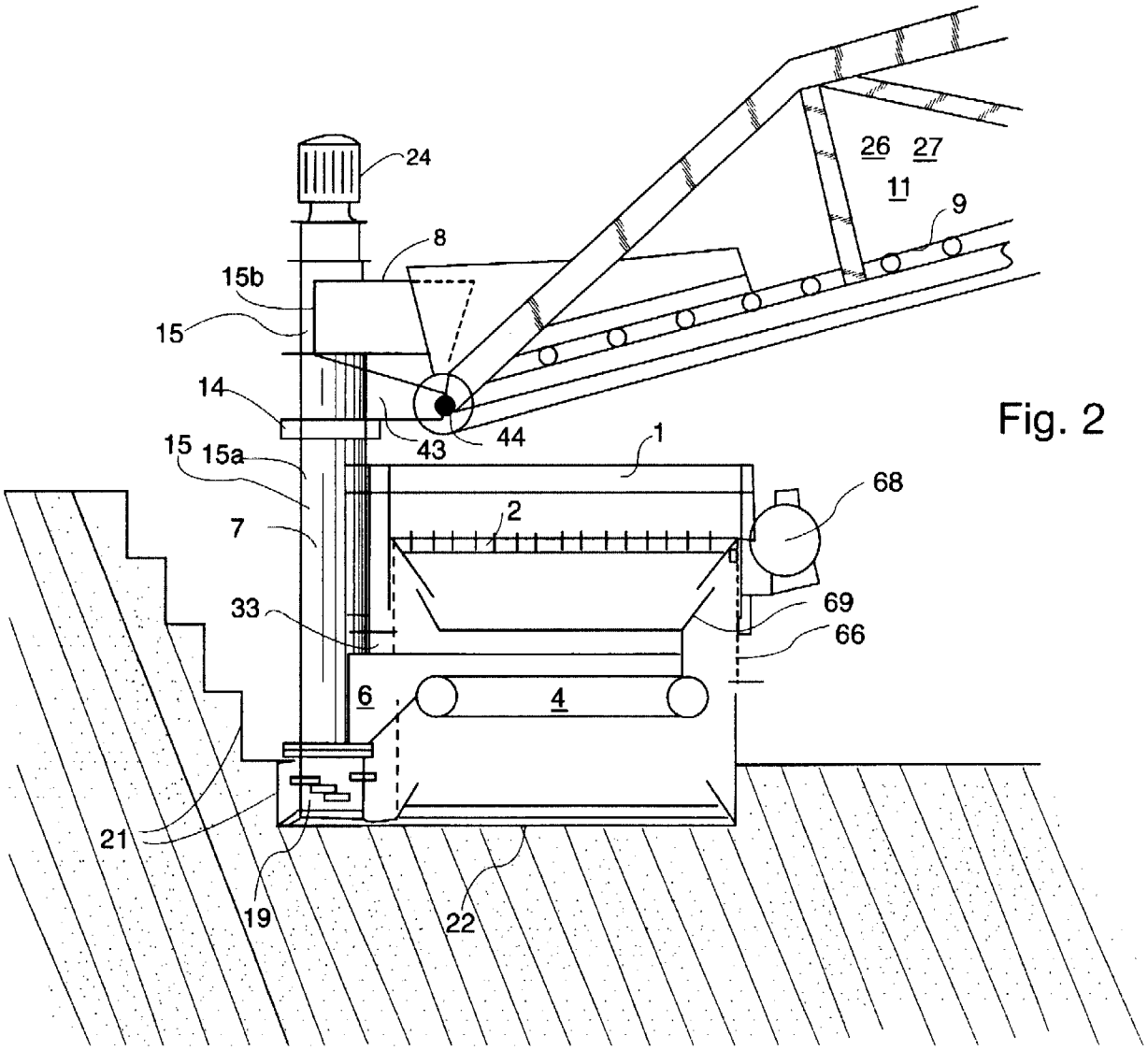
FIG. 2 a side elevation of the open cast mining apparatus with the cutting drum shown in section and the axial bulk material conveyor accommodated therein, the vertical worm conveyor and the connecting bridge linked thereto.
Figure 3:
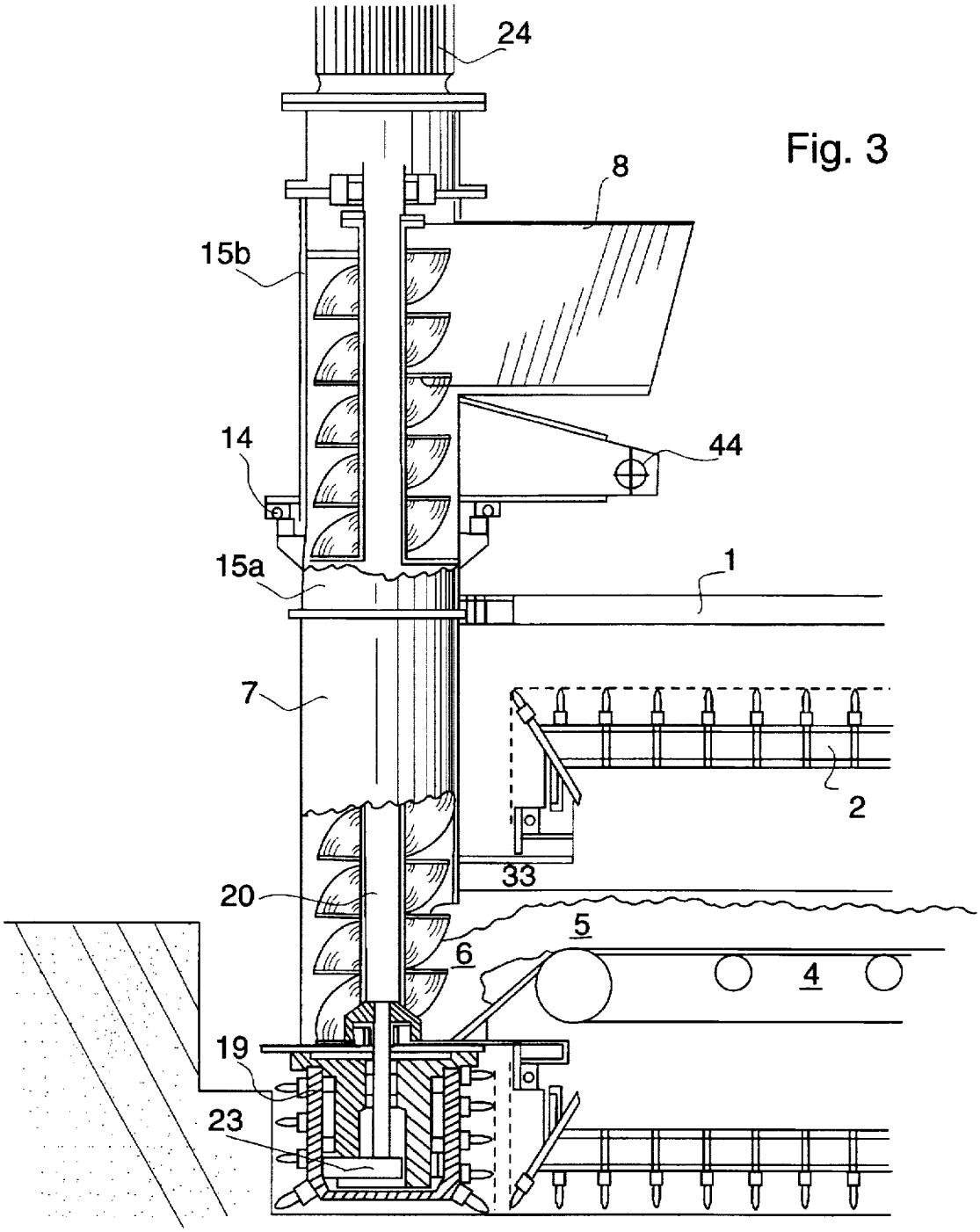
FIG. 3 an axial section through a portion of the horizontal cutting drum including a belt conveyor serving as axially orientated bulk material conveyor (4) as well as through the vertical worm conveyor with vertical cutting drum.
Figure 4:
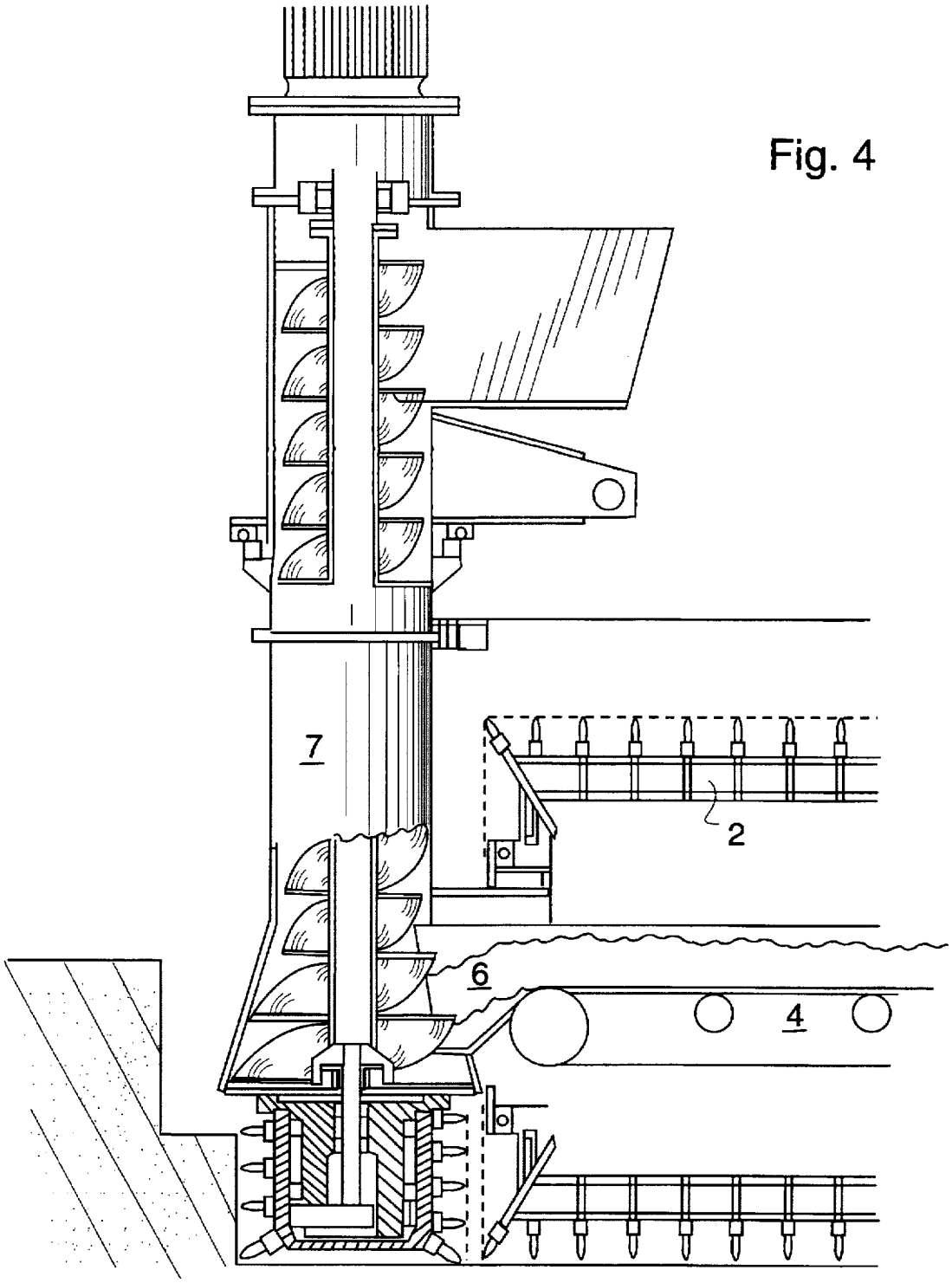
FIG. 4 an axial section as in FIG. 3, however, with a bulk material picking up region of frustro conical design of the worm conveyor.

The overall layout of the open cast mining apparatus is apparent from FIG. 1. The open cast mining apparatus, according to FIGS. 2 and 3, comprises a horizontally arranged cutting drum 2 and a vertically or perpendicularly arranged cutting drum 19 armed with cutting bits and driven by the worm shaft 20 of a vertical worm conveyor 7.

The material excavated by the horizontal cutting drum 2 is conveyed by an axial bulk material conveyor 4 in the direction of the vertical cutting drum 19 and is picked up by way of a bulk material receiving aperture 6 in the lower part of the vertical worm conveyor 7, conveyed upwardly and transferred by way of a bulk material transfer chute 8 into a further bulk material conveyor 9.

Figure 10:
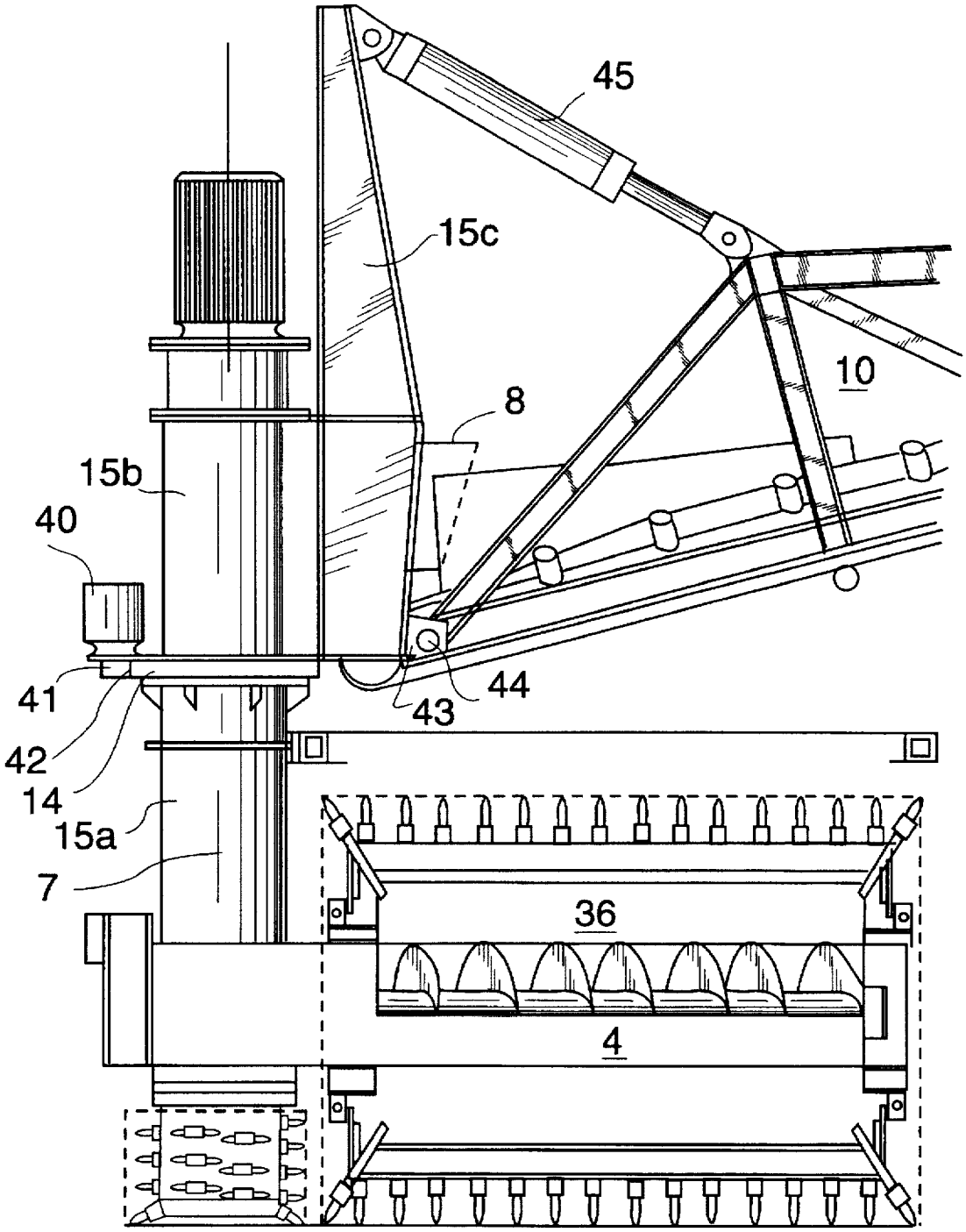
FIG. 10 an axial partial section through the open cast mining apparatus with the horizontal cutting drum illustrated in section and the worm conveyor axially accommodated therein with the vertical worm conveyor and the discharge jib provided in its upper region.
Figure 11:
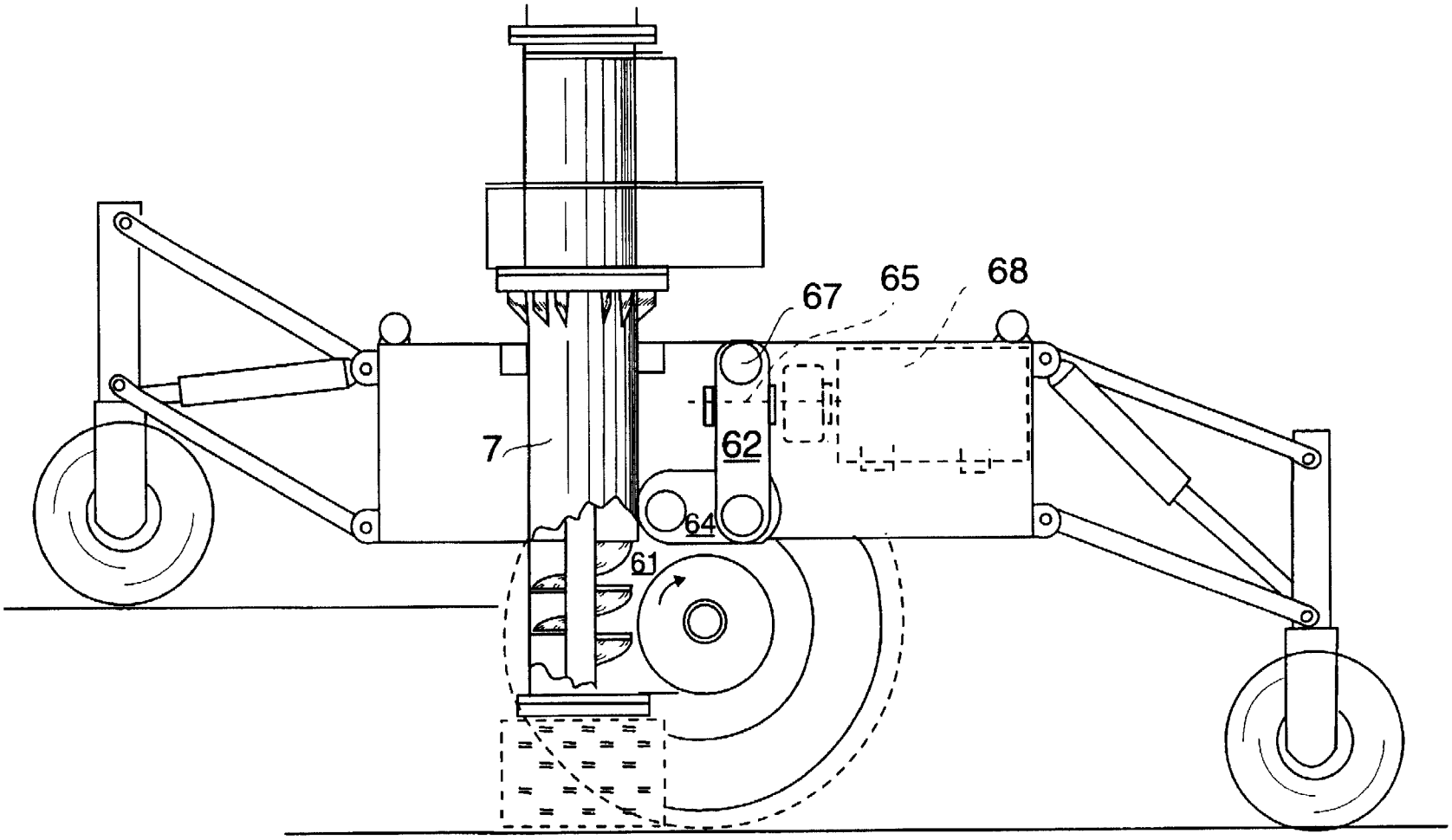
FIG. 11 a side elevation of the mining apparatus with worm conveyor serving as axial bulk material conveyor and, illustrated in section, a transfer chum (61) leading to the vertical worm conveyor and with drive means of the horizontal cutting drum, including a transmission on both end faces and only one motor illustrated in broken lines on the working face side.

This bulk material conveyor 9 may be accommodated in a discharge jib 10 or in a connecting bridge 11. The discharge jib 10 is swung according to FIG. 10 by means of a swinging mechanism 40 accommodated at the pivot bearing 14 about a vertical axis and by a lifting mechanism 45 about a horizontal axis. The connecting bridge 11 is supported on a loading carriage 13 which runs above or beside a working face belt 12. The bulk material conveyer 9 discharges the bulk material onto the working face belt 12. The bulk material conveyer 9 may be a belt conveyer or a worm conveyer.

The vertical worm conveyer 7 of the mining machine, by virtue of its construction, is an inherently robust bulk material conveyer. The worm tube 15 may be designed so strongly that it offers a good mechanical protection to the outside.

The inherently poor mechanical efficiency of a vertical worm conveyer 7, because of the small required height in this case, is of little importance.

The open cast mining apparatus, according to the invention, may also be employed particularly advantageously for the opening up of the pit. From DE 40 15 126 it is already known how to do so with the type of machine there described, the profile of the vertical conveyer deciding in that case the overall inclination of the pit outlines. The smaller the mining apparatus the larger is the C-shaped endless conveyer in relation to the horizontally arranged cutting drum and the less favourable do the conditions become regarding the attainable overall inclination of the pit outlines.

Because of the small vertical cutting drum 19 according to the invention it is now possible to produce pit outlines of any desired steepness.

The vertical cutting drum 19 is advantageously driven, as previously mentioned, by the worm shaft 20 of the worm conveyer 7. The cutting diameter of this vertical cutting drum 19 is somewhat larger than the outer diameter of the worm tube 15 so that the cutting profile of the smaller vertical cutting drum 19 may extend as closely as possible to that of the larger horizontally arranged cutting drum 2 in order to produce a track level which is as plane as possible.

The lower end face of the cutting profile of the smaller vertically arranged cutting drum 19 is positioned in the extension of the lower apex line of the cutting geometry of the larger horizontally arranged cutting drum 2.

The small vertical cutting drum 19 may be designed to be removable because it is required only in the production of a development ditch.

If the mining method is to be performed in accordance with DE 40 15 126, the vertical cutting drum 19 must be permanently installed because steep side slopes must be produced also at both ends of the working face.

If the vertical cutting drum 19 is driven from the worm shaft 20 by way of a planetary transmission 23 installed therein, the direction of rotation is non-variable. If the vertical cutting drum 19 is driven, however, by its own motor and by way of a shaft passing through the hollow worm shaft 20, or if the vertical cutting drum 19 is turned by a hub drive mechanism installed therein, its sense of rotation can be alternated. In that event, the picks of the vertical cutting drum 19 are fitted foldable in pairs as is the case in the horizontally orientated cutting drum 2.

In that case, the sense of rotation of the vertical cutting drum 19 is advantageously always so controlled that the bulk material excavated thereby is fed towards the horizontally arranged cutting drum 2.

Where the sense of rotation is invariable, a narrow strip of bulk material will always in one of the directions of travel be left behind at the base of the slope to be picked up during the next mining passage.

The worm tube 15 of the vertical worm conveyor is composed of two parts, a lower part 15*a* which is fixed to the chassis and an upper part 15*b* which is connected pivotally by way of a pivoting bearing 14 to the lower part 15*a*.

Figure 5:
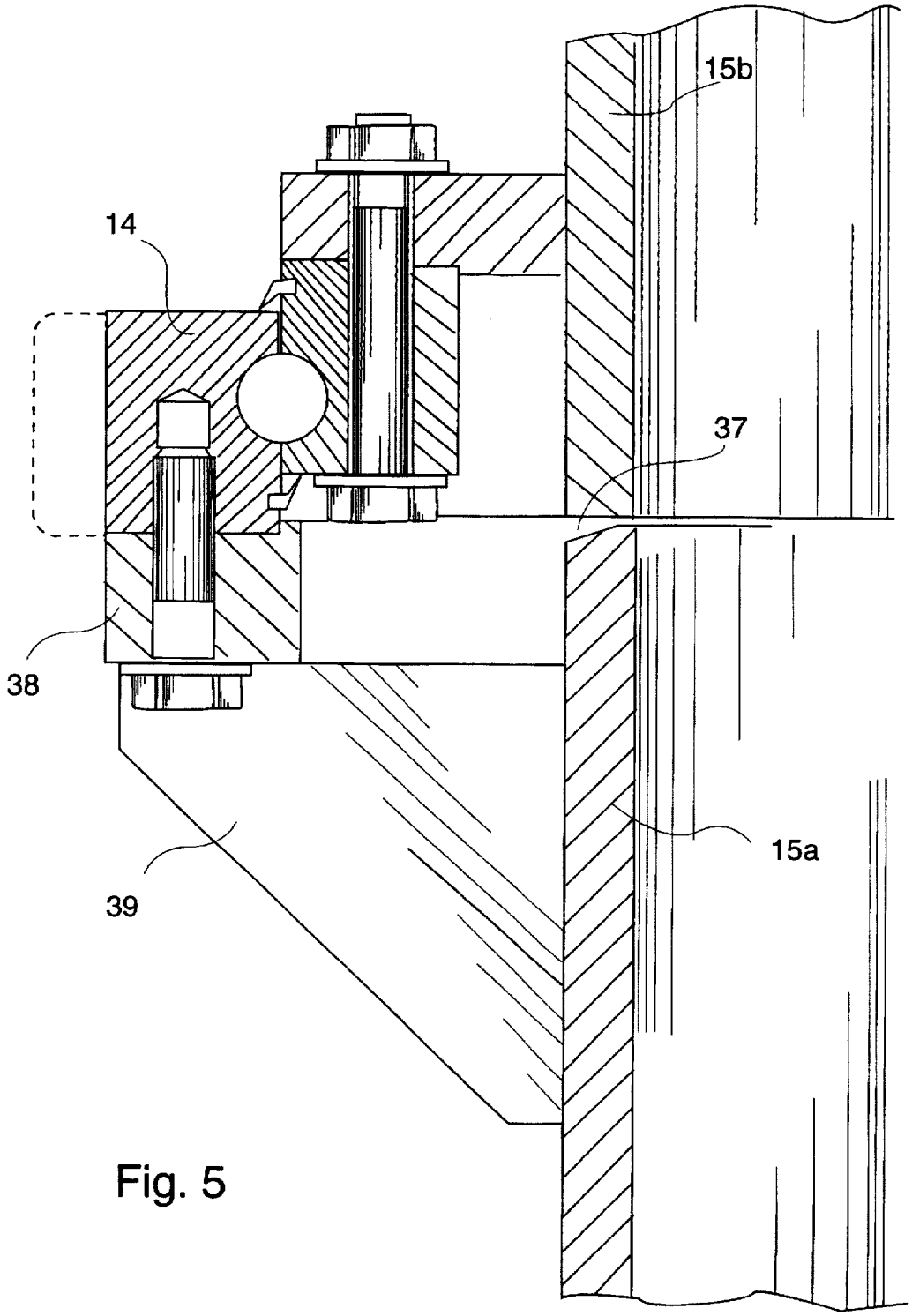
FIG. 5 a detail of the vertical worm conveyor including mounting bearings between the fixed and the pivotal tube.
Figure 6:
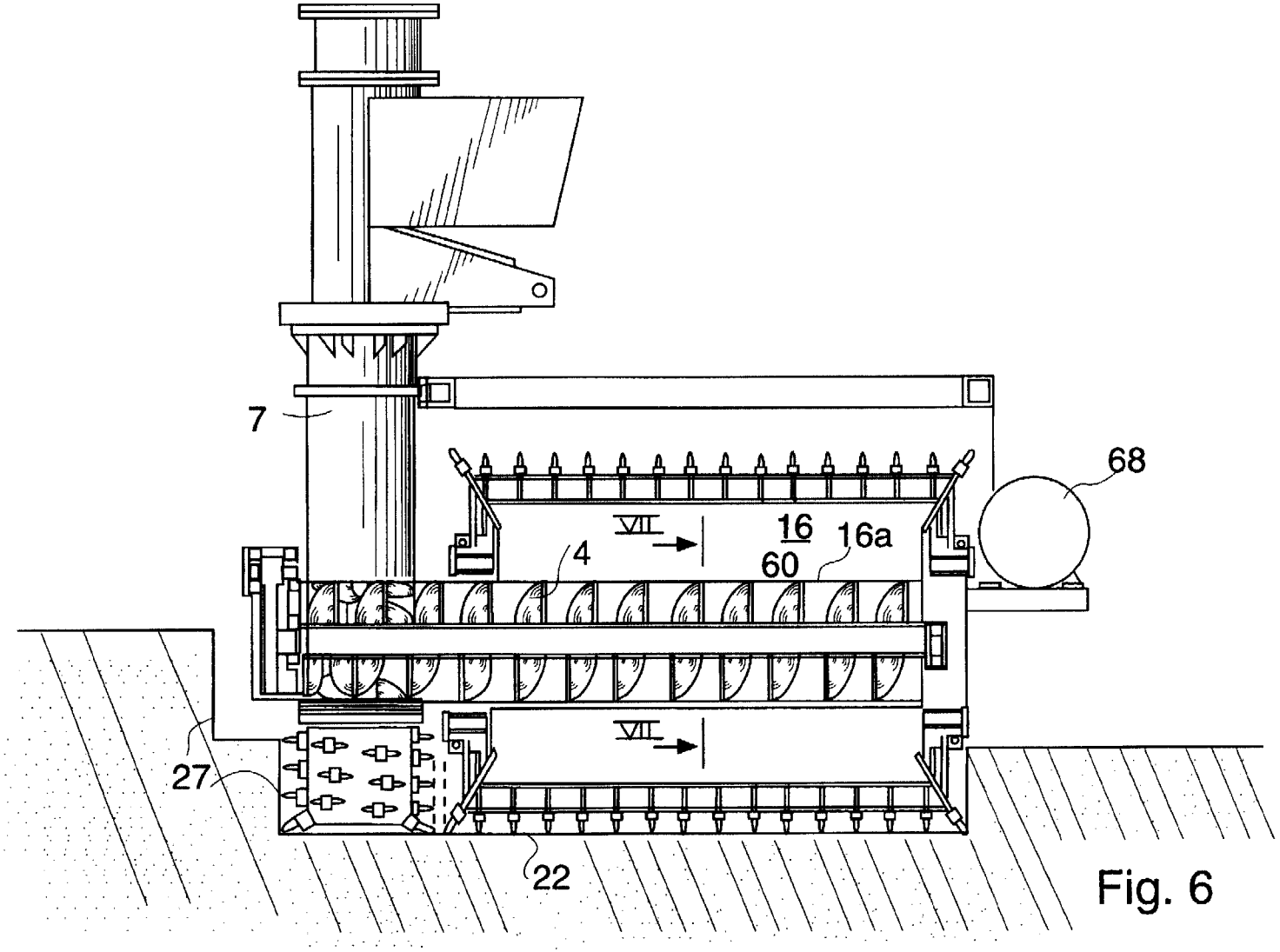
FIG. 6 an axial section through the horizontal cutting drum, including a worm conveyor serving as axial bulk material conveyor (4)

The gap 37, FIG. 5, between the two worm gear parts 15*a* and 15*b* is as narrow as possible at the inner diameter and widens in an outwards direction. In this manner little fine bulk material only can escape to the outside from the worm.

Because the gap flares 37 in outward direction, bulk material cannot become jammed therein. The fastening ring 28 for permanently fixing the pivoting bearing 14 to the lower worm tube 15*a* is connected to the latter by a multitude of ribs 39. Between the ribs the seepage of fines can drop onto the working track.

If a discharge jib 10 is provided at the upper vertical worm tube 15*b*, a pivoting bearing 14 is used into which teeth have been milled. A pivoting mechanism 40 engages these teeth by means of its drive pinion 41.

If, on the other hand, a connecting bridge 11 is linked to the upper worm tube 15*b*, a pivoting bearing 14 having no crown wheel and no pivoting mechanism is employed.

The upper worm tube 15*b* comprises a bulk material transfer chute 8, advantageously of a type as is known from DE 41 25 109. In that manner, the bulk material is ejected at high velocity (e.g. 4 to 8 m/s) aimed in a horizontal to slightly upward direction.

The bulk material conveyor 9, in the discharge jib 10 or in the connecting bridge 11, is pivotally mounted about a horizontal axis by means of two bearings 44 on two brackets 43 which are connected to the upper worm tube 15*b*, the bearings 44 and the bulk material conveyor 9 of the discharge jib 10 or the connecting bridge 11 being so arranged that the stream of bulk material flung but the worm conveyor 7 through the bulk material transfer chute 8 is centrally ejected onto the bulk material conveyor 9. If the bulk material is cast onto the bulk material conveyor 9 approximately at the conveyor velocity of the latter, it need not first be accelerated thereon. This permits the attainment of steeper conveyance angles.

If a discharge jib 10 is linked onto the upper tube a worm tube 15*b* in the region of the bulk material transfer chute 8 the lifting mechanism 45 for the discharge jib 10 is likewise fitted to the upper part of the worm tube 15*b* or an extension thereof. This may, for example, take the form of a hydraulic cylinder or a rope winch.

The bulk material conveyer 4, which is axially accommodated in the horizontal cutting drum 2, may be a belt conveyer or a worm conveyer. In both cases the bulk material passes by way of a chute 69 onto this bulk material conveyer 4.

Figures 7, 8, 9:
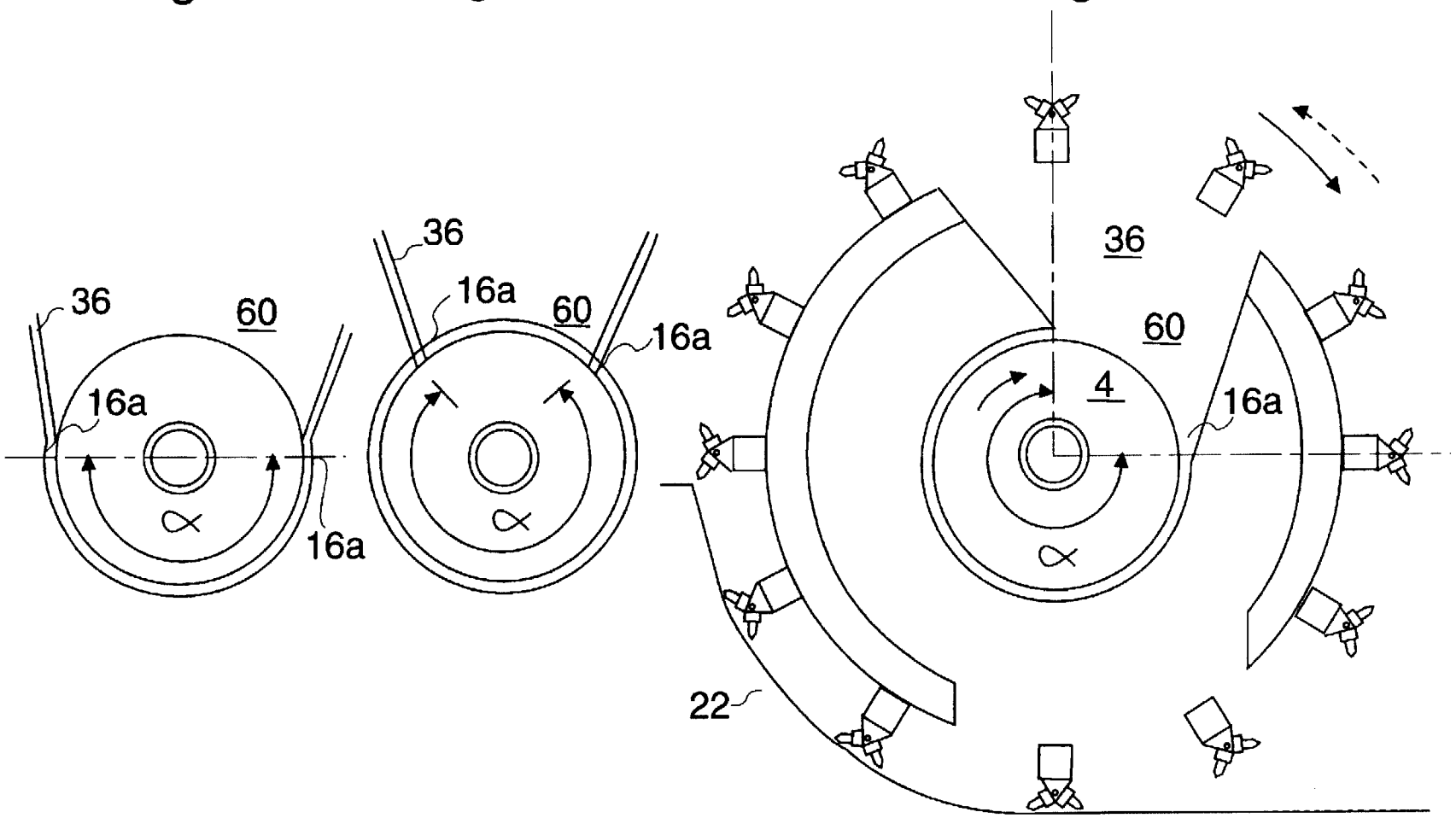
FIG. 7 section VII—VII according to FIG. 6 through the worm conveyor, including a portion of the chute (36) following thereon, wherein the trough, respectively the worm tube, embraces the worm at an angle $\alpha$ of 180°.
FIG. 8 as in FIG. 7, but wherein the trough embraces the worm at an angle $\alpha$ of about 270°.
FIG. 9 as in FIG. 8, however, with the chum (36) being asymmetrically fitted.

If the axial bulk material conveyer 4 is a worm conveyer, it will be advantageous if the worm is accommodated in a trough embracing it, not only in the usual manner in the lower cross-sectional half as shown in FIG. 7, but to a substantially greater extent so as to form a worm tube having an axially extending gap-shaped aperture 60, this aperture, according to FIG. 8, corresponding to an opening angle ($\alpha$) of less than 180°, preferable about 90°. It is thereby avoided that at relatively high rates of rotation of the worm, the bulk material is flung by the windings of the worm in an upward direction and this portion is no longer conveyed onwardly, whereby the overall maximum throughput is limited. An even larger throughput of the worm conveyer can be attained by the asymmetrical design of the worm conveyer in relation to the chute in accordance with FIG. 9.

The arrangement according to the invention of a horizontal worm conveyer as the axial discharge conveyer inside the horizontal cutting drum 2 is particularly advantageous if a mining machine of relatively small size is to be built. It is, for example, possible for a worm conveyer having a throughput of the order of 500 $m^3/h$ to pass through an end face aperture (33) of the horizontal cutting drum (2) of less than 800 mm diameter. With a belt conveyer, this would virtually not be possible anymore.

According to the invention, those parts of the worm conveyor in which bulk material may become jammed, are so dimensioned and designed that the maximum particle sizes which are possible there can be broken up without resulting in permanent damage.

The windings of the worm are manufactured in that region of sheet metal of greater thickness and are reinforced along the outer edges by armouting. The edges of the worm tube apertures are reinforced in the same manner.

Bulk materials such as black coal or limestone may, in that manner, be conveyed readily without the need for stoppages if individual lumps of conveyed material become jammed in the conveyor passage.

The end of the worm conveyor 7, which is adjacent the cutting roller 2, can be of a frustro conical configuration. The upper diameter of the frustro cone being equal to a diameter of the cylindrical part of the worm conveyor 7 in the upper region. The lower most diameter of the frustro conical configuration is greater than the cylindrical part of the worm conveyor. The height of the frustro cone approximately equals the height of the bulk material receiving aperture 6 of the worm conveyor 7.

The bulk material conveyor 9, in the connecting bridge 11, or in the discharge jib 10, may be a belt conveyor or a worm conveyor.

Figure 12:
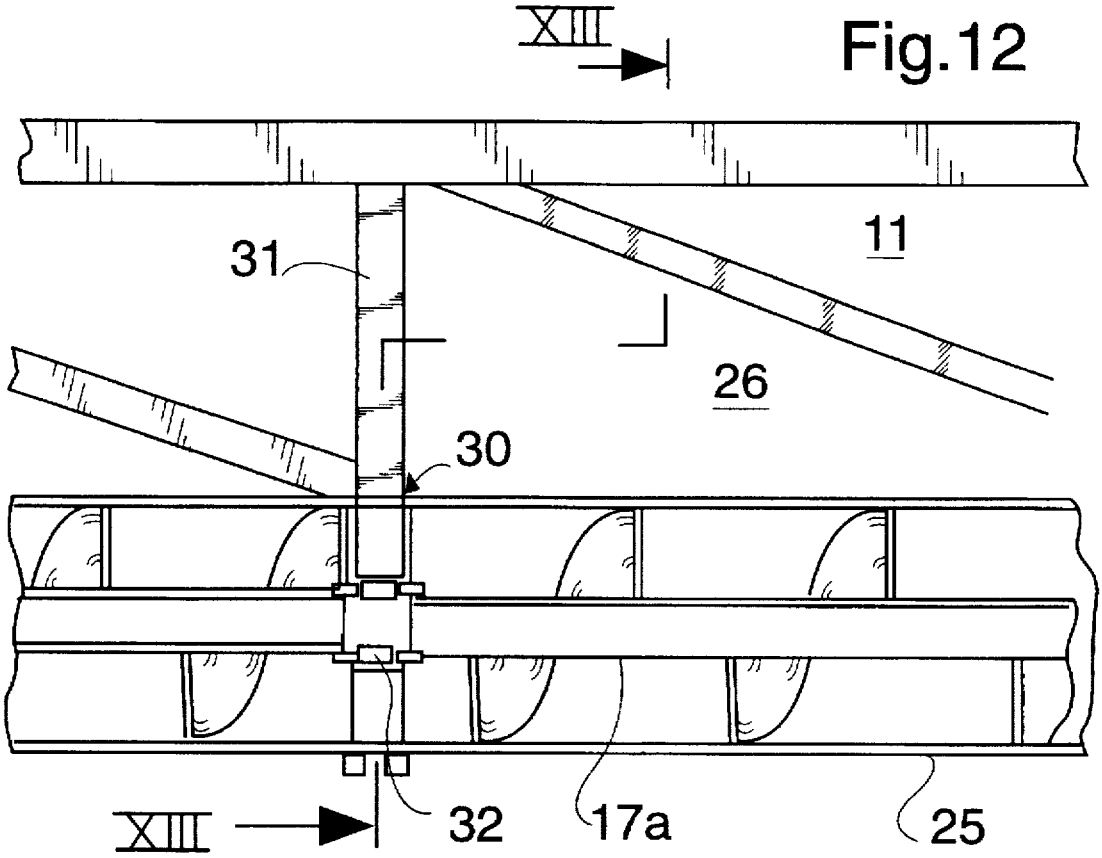
FIG. 12 a detail of the connecting bridge, including the worm conveyor shown in section.

In the event of a belt conveyor, a profiled belt, shown in FIG. 12, is used advantageously in order to achieve steep conveyance angles. Even steeper conveyance angles may be attained by the use of a worm conveyor in which the worm is embraced by a tubular trough, that is to say a worm tube 25. The poor mechanical efficiency is of lesser importance in the case of relatively small machines. In that case, on the other hand, the advantage of simple construction and the smaller number of components of which it is composed is of overriding importance.

In accordance with the invention, the upper half of the worm conveyor tube 25 is so combined with the trellis work 26 of the supporting construction 27 of the connecting bridge 11 as to form its bottom beam. The intermediate bearings 32 for the worm shaft are located where the vertical 31 and diagonal members of the vertical framework are connected as a junction point 30 to the worm conveyor tube.

The lower half 28 of the worm conveyor tube is subdivided into individual lengths, each extending from one intermediate support bearing to the next. These individual lengths are screwed one to the other and to the upper tube half. Being components subjected to wear, they are replaceable.

Figure 13:
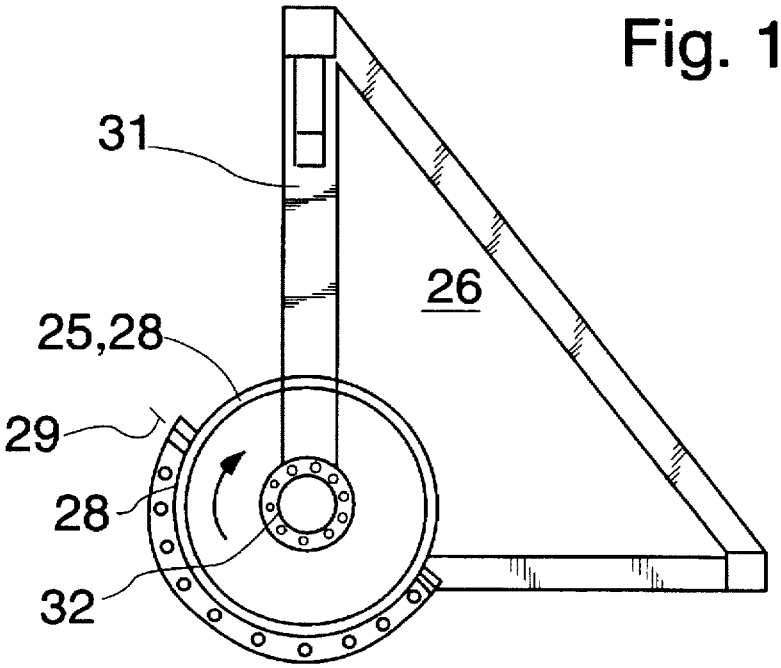
FIG. 13 section XIII—XIII according to FIG. 12.

The dividing groove 29 between the upper and the lower tube half is provided at an incline and not horizontally. This dividing line or groove 29 between the two half shells 28 is orientated transversely to the plane of the traverse structure 26. The lower half shell being in a transverse butt connection thereto at each junction point 30 of the traverse structure 26. The junction point 30 is where the vertical frame work members 31 abut against the worm tube 25. Intermediate bearings 32 of the worm shaft 17*a* are accommodated in the region of the junction points 30. The reason is that by the rotation of the worm shaft, and the forces generated thereby in the bulk material, the bulk material viewed in the direction of rotation of the worm is lifted in the rising portion. Due to the inclined arrangement of the dividing groove 29 according to FIG. 13, it is assured that only the replaceable half of the worm tube is subjected to wear.

Figure 14:
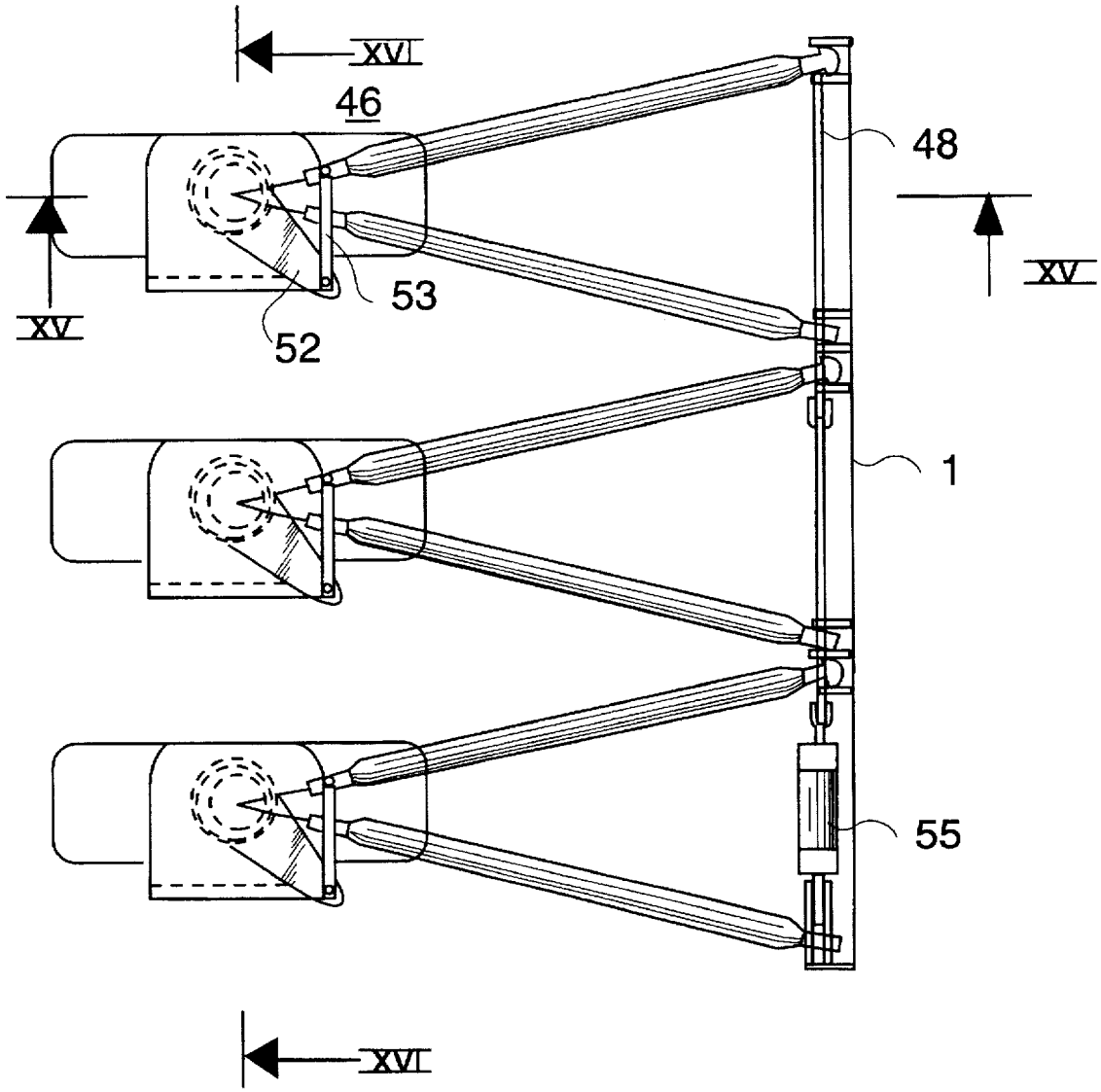
FIG. 14 a plan view of the steering mechanism of a group of three crawler or wheel sets (wheel sets with one wheel each are illustrated)
Figure 15:
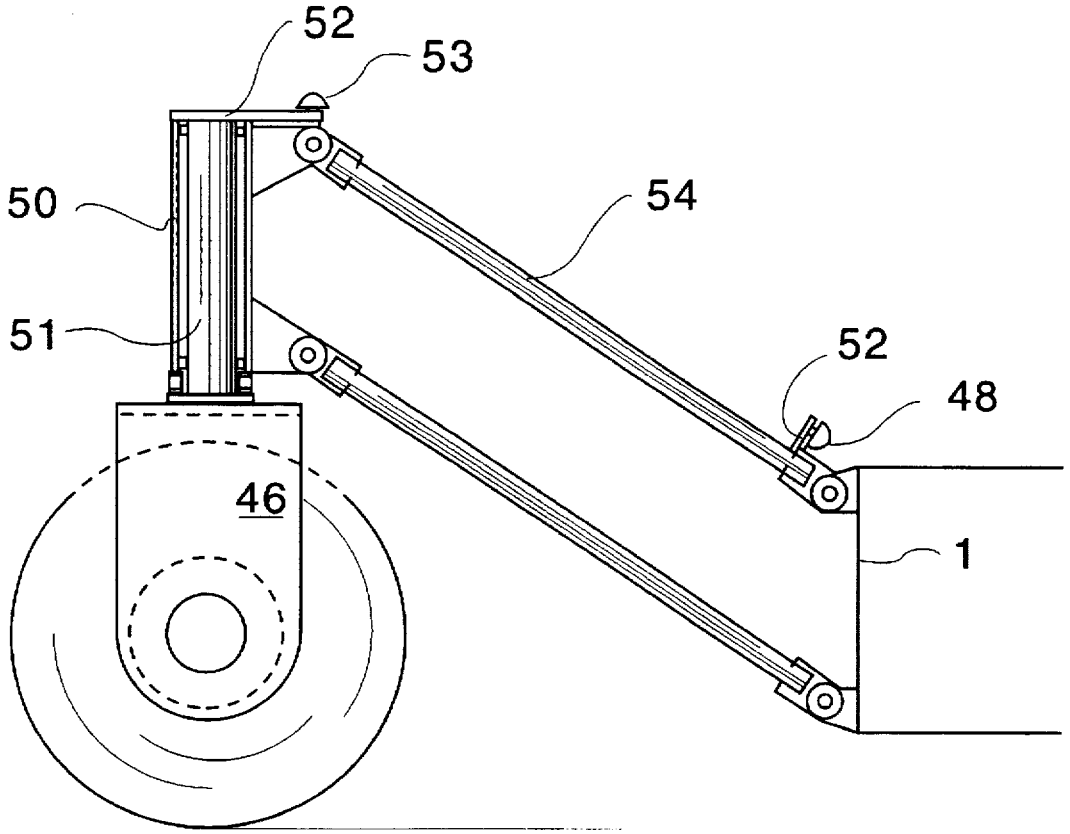
FIG. 15 section XV—XV according to FIG. 14.
Figure 16:
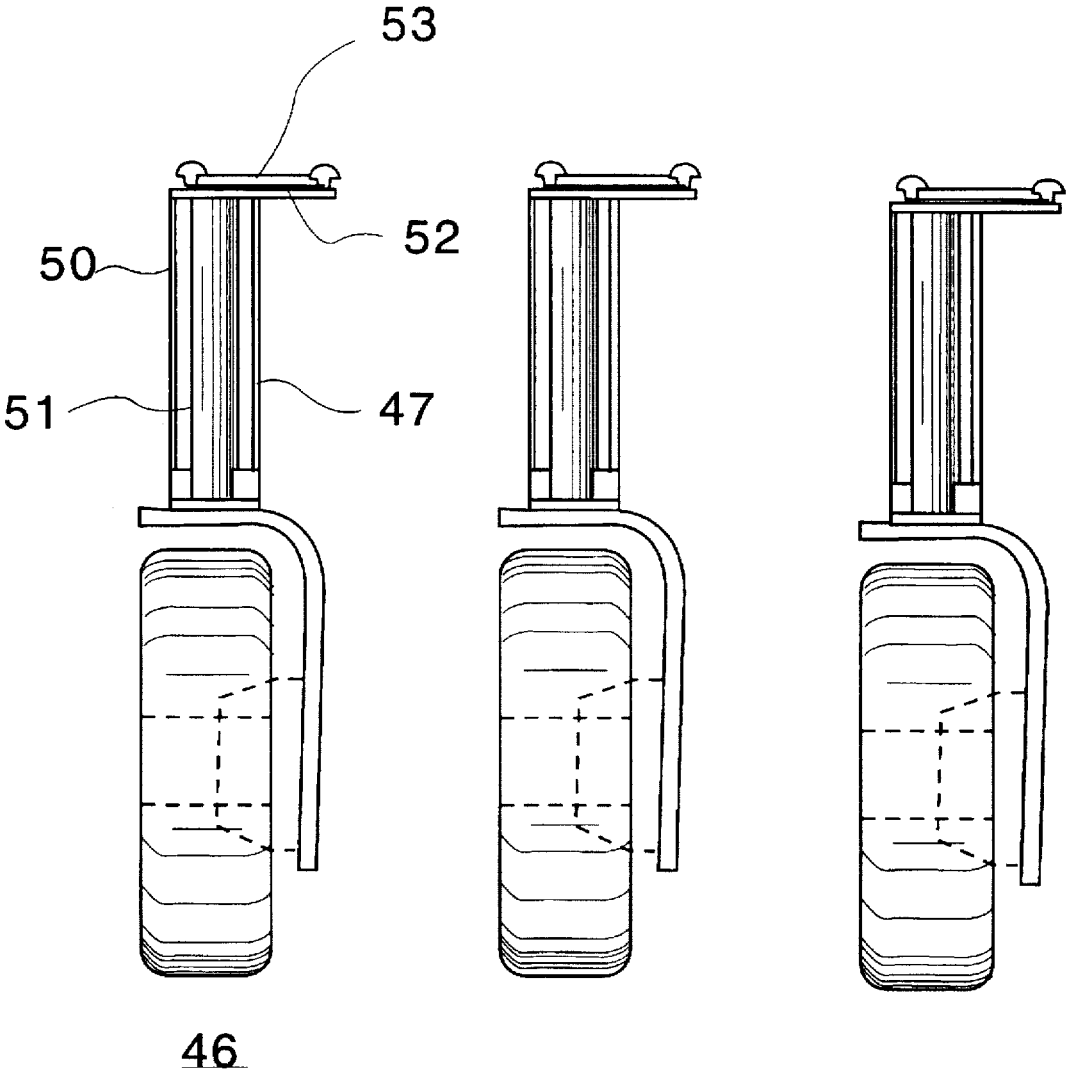
FIG. 16 section XVI—XVI according to FIG. 14.

In accordance with DE 39 20 011 the running gear of the open cast mining machine is composed of three or a larger number each of front and rear crawlers or wheel sets. Each crawler or each wheel set 46 is mounted according to FIGS. 14 to 16 at the lower end of a vertical column 47, each being connected by way of a pair 54 of upper and lower connecting rods and a lifting cylinder to the chassis 1. Each column 47 is composed of an outer tube 50 and a shaft 51 pivotally mounted therein.

Particularly in the case of a small machine as can be constructed advantageously according to this invention, each machine function must be performed with a minimum of components. It is also desirable that individual components should perform several functions. Accordingly, it is advantageous if, according to the invention, the steering mechanism for the running gear of the machine is designed as follows:

Each of the shafts 51, accommodated in a column 47 of a crawler or wheel set 46, is preferably equipped above its uppermost mounting bearing with a steering lever 52. This is engaged by a connecting rod 53 which, at its end on the column side is advantageously associated with one of the two upper parallelogram connecting rods 54. A similar lever is provided at the chassis side end of the same connecting rod. These levers of all adjoining running gear sets are interconnected by connecting rods. A lever is furthermore connected to the piston rod 44 of a steering cylinder 55.

By means of the two steering cylinders 55 of the front and rear sets of running gears, these may be steered individually. Each of these two steering cylinders 55 is fitted to a transverse edge of the chassis 1 and is provided with a position sensor preferably installed internally axially, for determining the steerage position at any given moment.

It is known from DE 40 17 107 to have a drive 62 the cutting drum 2 by way of two to four transmissions 64, each having two transmission pinions, the transmission pinions engaging into crown wheels provided on both end faces of the cutting drum 2 and preferably machined into the outer rings of the cutting drum bang. Each of these transmissions 64 is driven by a motor 68 through a transmission input stage 65.

Those transmissions 64, which are respectively on opposite sides, are interconnected according to the invention each by a coupling shaft 67. This serves to compensate for uneven loads applied across the width of the cutting drum which might result in torsional stressing of the cutting drum body. Due to this coupling of the respective right hand and left hand transmissions 64, it is possible to construct the cutting drum 2 in a torsion yielding and therefore considerably lighter manner.

According to the invention, only that (or those two) transmission(s) which is/are on the side opposite to the worm conveyor, such as the front side 66 of the cutting drum 2, is/are equipped with motors. The opposite transmission(s) is/are then driven by way of the coupling shaft(s). By this arrangement the (the two) motor(s), provided exclusively on the working face side form(s) a counter weight for the worm conveyor and the bridge load applied thereto.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. Open cast mining apparatus including a cutting drum fitted underneath a chassis and including travel gear sets adapted to be raised, lowered and steered, said gear sets being fitted respectively ahead of and behind the chassis, viewed in a travel direction, and cutting drum drive means provided at both end faces and including a chute axially accommodated in the cutting drum and an axially arranged bulk material conveyor, wherein at one end face aperture of the horizontally positioned cutting drum a vertical worm conveyor is provided, extending to a level above the apparatus chassis, wherein at the lower end of the vertical worm conveyor a vertical cutting drum is provided which revolves coaxially in relation to the worm conveyor, wherein the axial bulk material conveyor accomodated in the horizontal cutting drum discharges the bulk material into a bulk material receiving aperture at the lower end of the vertical worm conveyor, and wherein at the upper end of the worm conveyor a bulk material transfer chute is provided which transfers the bulk material onto a bulk material conveyor.

2. Open cast mining apparatus according to claim 1, wherein the vertically placed cutting drum is driven by worm drive means by way of the worm conveyor and by way of a coaxial transmission built into this cutting drum.

3. Open cast mining apparatus according to claim 1, wherein both cutting drums, in accordance with the prevailing direction of cutting, each operate with a sense of rotation so adapted that the horizontal cutting drum revolves in a counter flow cutting direction and the vertical cutting drum revolves in that direction of rotation by which the bulk material cut by it is conveyed in the direction towards the horizontal cutting dram.

4. Open cast mining apparatus according to claim 1, wherein a cylindrical cutting profile of the vertical cutting drum closely adjoins an end face cutting profile of the horizontal cutting drum and the lower end face cutting profile of the small cutting drum is positioned in the extension of the lowermost apex line of the cutting profile of the horizontal cutting drum.

5. Open cast mining apparatus according to claim 1, wherein a worm tube of the worm conveyor is composed of an upper and lower tube interconnected by a pivot bearing and being pivotal in relation to one another, the lower tube being connected to the apparatus chassis and the upper tube being connected to a discharge boom or a connecting bridge including said bum material conveyor accommodated therein.

6. Open cast mining apparatus according to claim 5, wherein the pivot bearing has a lowermost fastening ring fitted by means of ribs to the lower tube.

7. Open cast mining apparatus according to claim 5, wherein the bulk material conveyor is a worm conveyor.

8. Open cast mining apparatus according to claim 5, wherein the discharge boom or the connecting bridge is fitted to the upper worm tube by way of two supporting brackets, being mounted pivotally about a horizontal axis by way of two bearings.

9. Open cast mining apparatus according to claim 1, wherein the bulk material receiving region of the worm conveyor is of frustro conical configuration, the upper diameter of the frustro cone being equal to the diameter of that cylindrical part of the worm conveyor which adjoins it in the upper region, and the lowermost diameter is greater and the height of the frustro cone approximately equals the height of the bulk material receiving aperture of the worm conveyor.

10. Open cast mining apparatus according to claim 1, wherein the bulk material conveyor accommodated in the horizontal cutting drum is represented by a belt conveyor which on the discharge side terminates in front of the bulk material receiving aperture of the vertical worm conveyor.

11. Open cast mining apparatus according to claim 1, wherein the bulk material conveyor accommodated in the horizontal cutting drum is a worm conveyor.

12. Open cast mining apparatus according to claim 11, wherein a worm tube of said worm conveyor is at its upper end connected to said bulk material transfer chute and in a lower region of the chute defines a slot-shaped aperture.

13. Open cast mining apparatus according to claim 12, wherein a width of the slot-shaped aperture corresponds to an aperture angle $\propto$ of less than 180°.

14. Open cast mining apparatus according to claim 13, wherein said aperture angle $\propto$ is about 90°.

15. Open cast mining apparatus according to claim 13, wherein the worm conveyor accommodated in the horizontal cutting drum is provided laterally displaced in relation to the center line of the chute in such a manner that the slot-shaped aperture lies in the region of the upper descending quadrant of the worm cross-section.

16. Open cast mining apparatus according to claim 11, wherein the vertical worm conveyor, viewed in the direction of travel, is provided in front of or behind the axial bulk material conveyor being in the form of a worm conveyor, worm tubes of both worm conveyors adjoining each other closely and being interconnected by a transfer passage.

17. Open cast mining apparatus according to claim 11, wherein a worm tube of the worm conveyor is provided with a traverse structure and jointly therewith forms the bridge support structure, wherein the worm tube is longitudinally divided into two half shells.

18. Open cast mining apparatus as claimed in claim 17, wherein the dividing line between the two half shells is orientated transversely to the plane of the traverse structure, the lower half shell being in transverse butt connection thereto at each junction point of traverse members and that in the region of the junction points, where the vertical framework members abut against the worm tube, the intermediate bearings of the worm shaft are accommodated.

19. Open cast mining apparatus according to claim 1, wherein the cutting drum drive means on that side which comprises the vertical worm conveyor is composed solely of a gear wheel, reduction gear drive and transmission, these transmission input stages are connected by torsion-proof coupling shafts to those of the cutting drum drive means provided on the opposite end face of the cutting roller in such a manner that the motors installed on the side opposite to the vertical worm conveyor form a counter weight to the vertical worm conveyor and to the bridge or discharge boom load acting thereon.

20. Open cast mining apparatus according to claim 1, wherein the running gear sets which viewed in the direction of travel are respectively positioned in front of or behind the chassis altogether consisting of a plurality of crawlers or wheel sets are each steered by one steering cylinder which, by way of connecting rods and steering levers each turn a parallelogram connecting rod mechanism of each running gear and whereby by way of further connecting rods and steering levers the associated crawler or the associated wheel set is steered.

21. An open cast mining apparatus comprising:

a chassis;

travel gear sets connected to said chassis and having means for raising, lowering and steering said chassis;

a cutting drum connected to said chassis, said cutting drum defining an aperture;

cutting drum drive means for driving said cutting drum;

a perpendicular worm conveyor positioned substantially perpendicular to said cutting drum, said perpendicular worm conveyor having one end positioned adjacent said aperture of said cutting drum, said one end defining a bulk material receiving aperture, said perpendicular worm conveyor having another end extending past said chassis;

a perpendicular cutting drum positioned substantially perpendicular to said cutting drum, said perpendicular cutting drum being connected to said one end of said perpendicular worm conveyor and rotating coaxially in relation to said perpendicular worm conveyor;

cutting drum conveyor means positioned axially in said cutting drum for conveying bulk material from said cutting drum into said bulk material receiving aperture;

bulk material transfer chute connected to said another end of said perpendicular worm conveyor and for receiving the bulk material from said perpendicular worm conveyor;

bulk material conveyor connected to said bulk material transfer chute and for receiving the bulk material from said bulk material transfer chute.

* * * * *